United States Patent [19]

Kanno

[11] Patent Number: 5,020,492

[45] Date of Patent: Jun. 4, 1991

[54] WARNING SYSTEM FOR MARINE PROPULSION ENGINE

[75] Inventor: Isao Kanno, Hamamatsu, Japan

[73] Assignee: Sanshin Kogyo Kabushiki Kaisha, Hamamatsu, Japan

[21] Appl. No.: 573,852

[22] Filed: Aug. 28, 1990

[30] Foreign Application Priority Data

Aug. 28, 1989 [JP] Japan ..... 1-221333

[51] Int. Cl.[5] ..... F02B 77/00

[52] U.S. Cl. ..... 123/198 D; 123/41.15

[58] Field of Search ..... 123/41.15, 196 S, 198 D, 123/421

[56] References Cited

U.S. PATENT DOCUMENTS

| | | | |
|---|---|---|---|
| 4,019,489 | 4/1977 | Cartmill | 123/41.15 |
| 4,475,498 | 10/1984 | Hurner | 123/41.15 |
| 4,562,801 | 1/1986 | Koike | 123/196 S |
| 4,606,315 | 8/1986 | Tobinaga et al. | 123/417 |
| 4,641,618 | 2/1987 | Dogodko et al. | 123/198 D |

*Primary Examiner*—Noah P. Kamen

*Attorney, Agent, or Firm*—Ernest A. Beutler

[57] ABSTRACT

Several embodiments of warning systems for marine propulsion engines wherein the operator is provided with a reset device for resetting the warning and wherein the warning is held in its warning mode for a predetermined time even if the operator resets.

2 Claims, 5 Drawing Sheets

WARNING SYSTEM FOR MARINE PROPULSION ENGINE

BACKGROUND OF THE INVENTION

This invention relates to a warning system for a marine propulsion engine and more particularly to an improved warning system that will provide an operator the indication of a warning in the event of an abnormal condition and which will prevent disabling that warning for a period of time so as to enable the operator to determine the cause of the malfunction or generation of the warning signal.

It is well known in a variety of applications to provide a warning arrangement that will provide the operator with a warning in the event of an abnormal condition. In addition, such warning systems may also include protection systems for the engine so as to slow or stop the speed of the engine in the event an abnormal condition is sensed. For example, there have been proposed lubricant level sensors for marine propulsion engines having separate lubricating devices that will provide a warning indication when the lubricant level falls below a predetermined value. At the same time, an arrangement is provided for insuring that the engine will be protected in the event of low lubricant level by the slowing of the engine speed.

However, with such devices there is a concern that if the abnormal condition is rectified, either by adding lubricant to the lubricant reservoir or by shaking of the float operated valve that indicates the lubricant level the engine speed may rapidly return and the operator might be caught unaware. In order to preclude this possibility, such systems also employ arrangements wherein once the warning has been initiated, a holding circuit is energized and that holding circuit cannot de-energized until the operator takes some predetermined operation such as reducing the amount of throttle opening, shifting the transmission into neutral or the like.

In connection with such systems, however, once the warning has been sounded frequently the operator may take the action necessary to reset the device such as by slowing the throttle or shifting the transmission into neutral. With the previously proposed systems, such action resets the entire operation and thus does not permit the operator to ascertain the cause for warning.

It is, therefore, a principal object of this invention to provide an improved warning system for a marine propulsion engine wherein a warning is given to the operator in the event of a malfunction and even if the operator takes steps to reset the system the warning will be prolonged for sufficient time for the operator to ascertain the reason for the warning.

It is a further object of this invention to provide an improved warning system for a watercraft wherein the warning system and engine protection system are initiated in the event of a predetermined condition and wherein even if the operator takes the reset modes the system will not return to normal operation until a predetermined time period has elapsed.

SUMMARY OF THE INVENTION

This invention is adapted to be embodied in a warning system for a marine propulsion engine having an engine that is operable in a normal mode. A detection means is provided for detecting an abnormal condition and a warning system is initiated in the event the abnormal condition is sensed. The operator is provided with a means for resetting the warning system to its normal operating mode. In accordance with the invention, however, a holding arrangement is provided for holding the system in its warning mode for a predetermined time period even if the operator resets the system.

DETAILED DESCRIPTION OF THE PREFERRED EMBODIMENTS OF THE INVENTION

Figure 1:
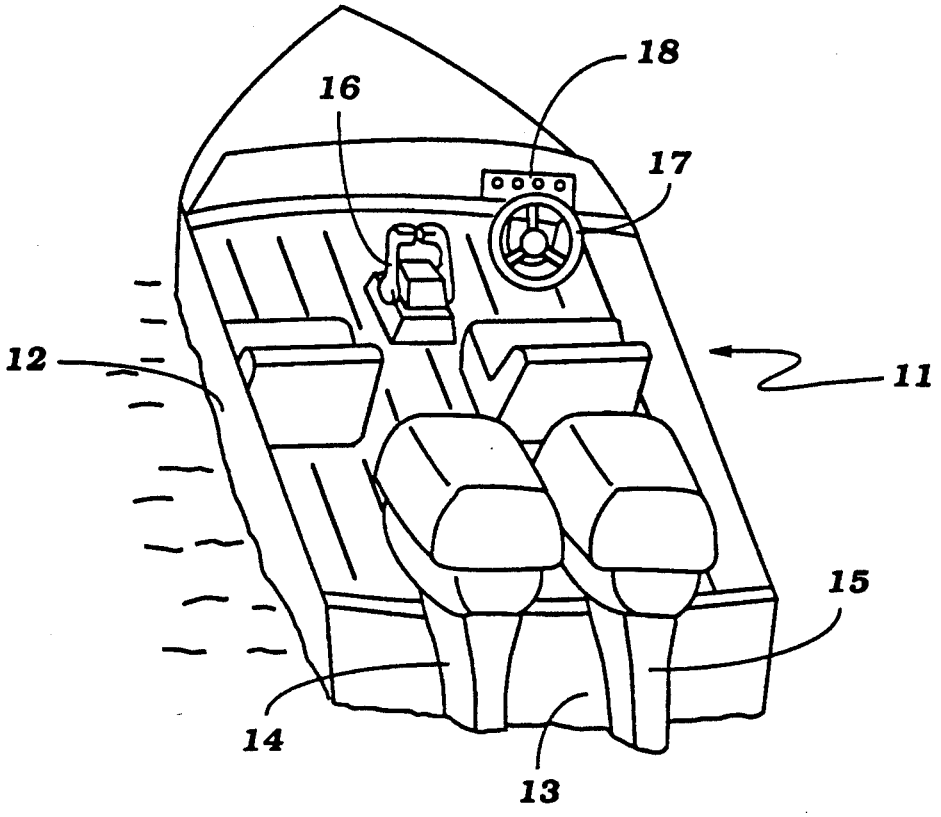
FIG. 1 is a perspective view of a watercraft having a warning system constructed in accordance with an embodiment of the invention.

Referring first to FIG. 1, a watercraft embodying a warnings system constructed in accordance with an embodiment of the invention as identified generally by the reference numeral 11. In the illustrated embodiment, the watercraft 11 is of the outboard type and includes a hull 12 having a transom 13 on which are mounted a pair of outboard motors 14 and 15. It is to be understood that even though the invention is described in conjunction with a system having a pair of outboard motors, the invention may be embodied in engines or arrangements having dual stern drives or, for that matter, a single outboard motor or a single stern drive.

The hull 12 defines a passenger compartment in which a control 16 is provided which may be comprised of a throttle control and transmission control for each of the outboard motors 14 and 15. In addition, a steering wheel 17 is provided forwardly of the operator so as to afford steering of the watercraft in a known manner. A control panel 18 is positioned behind the steering wheel 17 and includes a number of control and condition indicators such as warning indicators, as will be hereinafter described.

Figure 2:
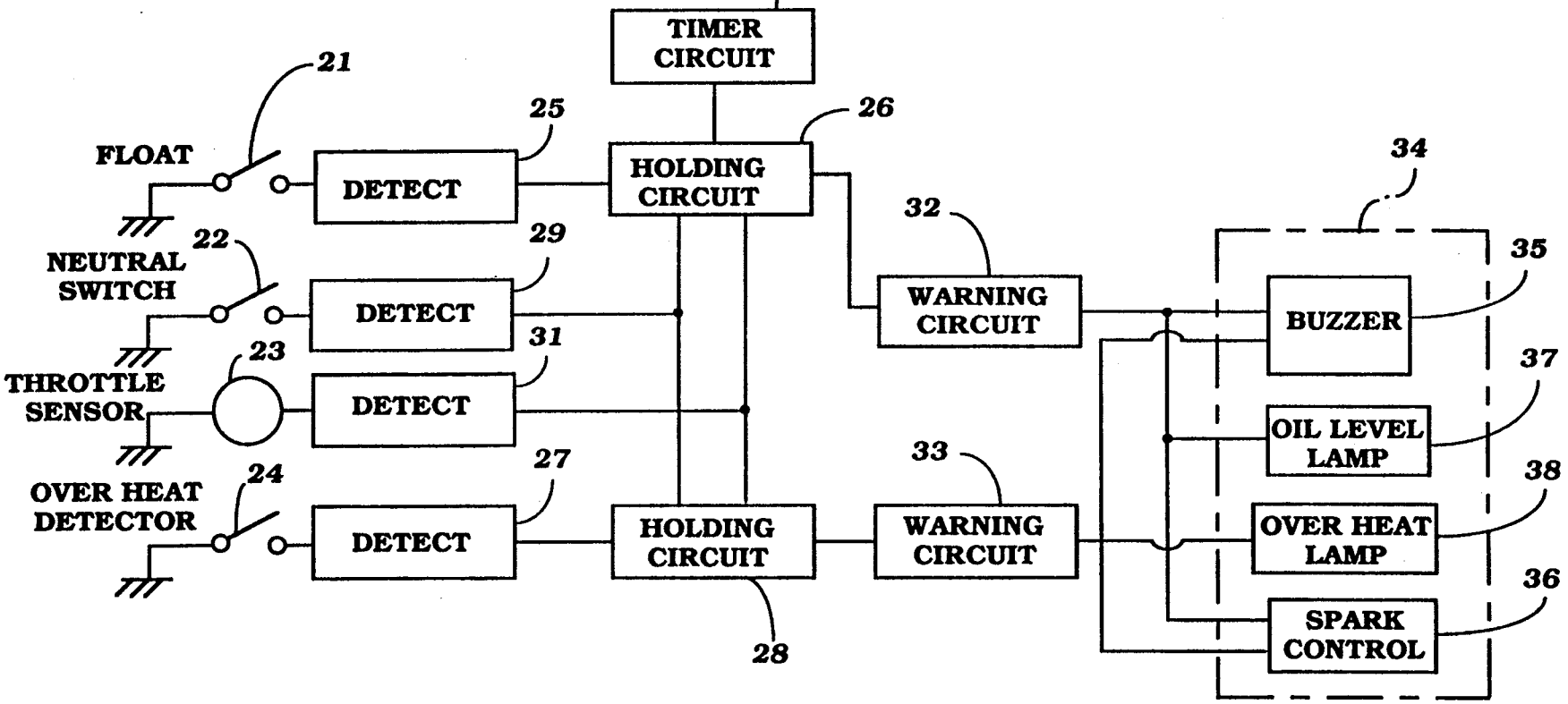
FIG. 2 is a schematic diagram showing the warning system in accordance with a first embodiment of the invention.

As has been previously noted, the invention may be employed in conjunction with dual outboard motors or dual stern drives. In such event, each powering engine or outboard motor may be provided with its own control circuit and warning circuit. In addition, the control and warning circuits may be interrelated in such a way that an abnormal condition of one of the propulsion units will result in warning from both propulsion units and the appropriate control therefore. However, the invention may also be employed in conjunction with single controls and FIG. 2 shows such an embodiment. It should be readily apparent to those skilled in the art how the invention can be employed in conjunction with interrelated dual controls or dual propulsion units.

Referring now in detail to FIG. 2, the warning system includes a number of detectors that detect either normal or abnormal conditions. These detectors may include such things as a float operated switch 21 that senses the level of lubricant in a lubricant reservoir for the internal combustion engines of the outboard motors 14 or 15 or inboard engines that drive stern drive propulsion units. In addition, there is provided a neutral switch 22 that is interrelated with the transmission controls in some manner so as to provide an indication of when the transmission is in a neutral position. There is also provided a throttle position detector 23 which may provide a signal when the throttle is returned to an idle or near idle condition. Furthermore, there is provided a temperature sensing switch 24 which may comprise an overheat detector for detecting an overheat condition in the outboard motors 14 or 15. It is to be understood that other types of abnormal condition detectors than the float operated switch 21 or the overheat detecting switch 24 may be employed. In addition, it is not necessary for two abnormal condition detectors to be employed in that the system can be utilized in conjunction with arrangements that sense only one abnormal condition of the propulsion unit.

The float operated switch 21 is interconnected with a detector circuit 25 which will detect when the float operated switch 21 has been closed or, alternatively, opened depending on its mode of operation and outputs a signal in that event to a holding circuit 26. In a like manner, the overheat detector switch 24 is coupled to a detector circuit 27 which also outputs a signal to a holding circuit 28 in the event the abnormal temperature is sensed. There are also provided respective detectors 29 and 31 that are coupled to the neutral switch 22 and throttle position sensor 23 so as to provide reset signals to the holding circuits 26 and 28 in the event the transmission is returned to neutral or the throttle is returned to its idle condition. This assumes that either or both of these condition indicators will be utilized to reset the device. As aforenoted various other types of reset mechanisms may be employed.

Each of the holding circuits 26 and 28 outputs its signal to a respective warning circuit 32 or 33 which, in turn, appropriately actuate certain warnings of a warning device, indicated generally by the reference numeral 34. The warning device 34 includes a warning buzzer 35, and an engine protection circuit 36. The engine protection circuit 36 may be of the type that reduces the engine speed in the event of an abnormal condition so as to prevent damage. This can be by misfiring the spark plugs or in any of the other well known protection manners. In addition, the warning unit 34 includes an oil warning indicator lamp 37 and an overheat temperature indicating lamp 38.

In the event a low oil level is sensed, the warning circuit 32 activates the warning buzzer 35, the oil level indicator lamp 37 and the spark control or engine protecting circuit 36. If the warning circuit 33 outputs a signal, the warning buzzer 35 is sounded and the engine protection circuit 36 is activated. In addition, the overheat indicator lamp 38 will be illuminated.

Figure 3:
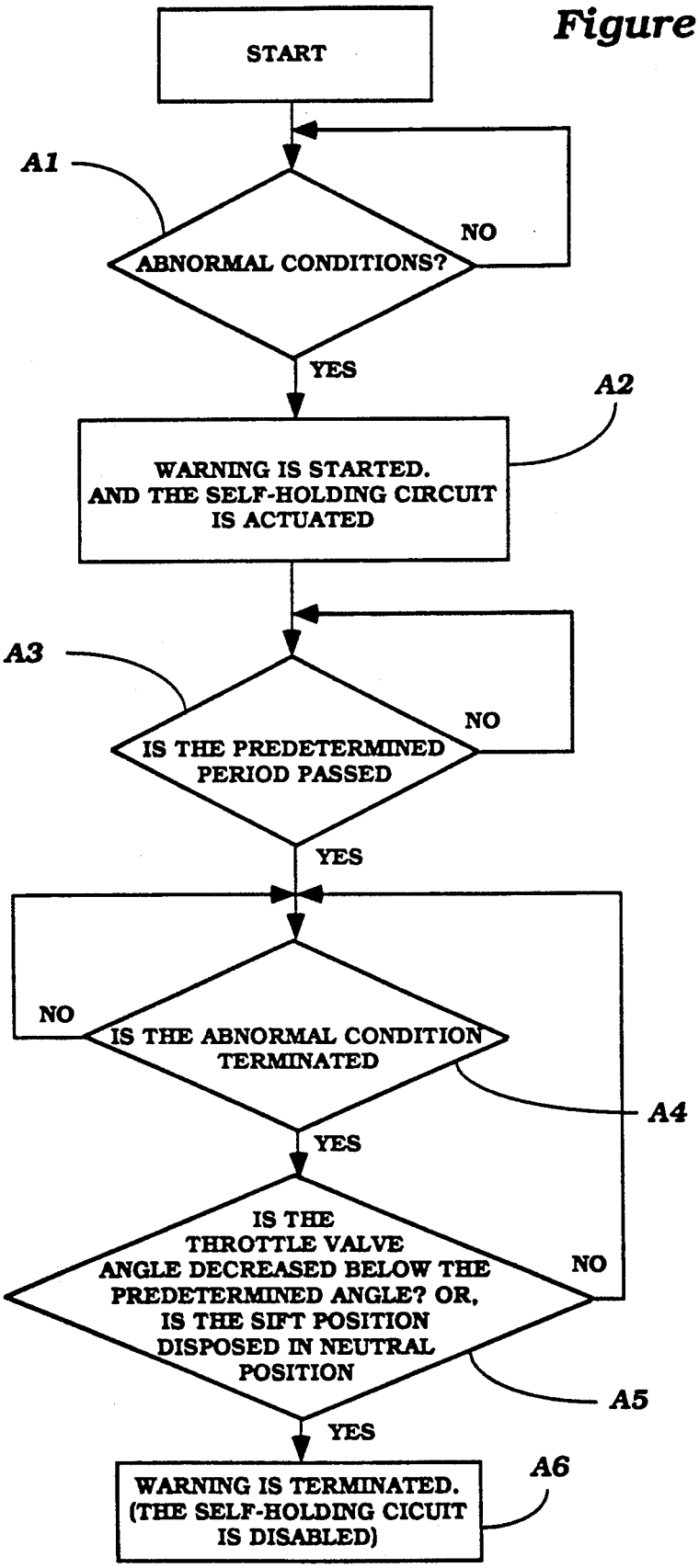
FIG. 3 is a block diagram showing the control routine of this embodiment.

In accordance with the invention, there is provided additionally a timer circuit 39 which controls both the holding circuit 26 and the holding circuit 28 and holds them on for a predetermined time period regardless of whether the abnormal condition has been rectified and/or the reset system comprised of either returning the transmission to neutral or the throttle to idle has been done. The mode of operation is shown in FIG. 3 whereupon start the program moves to the step $A_1$ to determine if there is an abnormal condition sensed by either the switches 21 or 24. If there is not, the program continues to repeat.

If, on the other hand, at the step $A_1$ an abnormal condition is sensed, then, the holding circuits 26 or 28 are started and in addition the timer circuit 39 is begun to run. The program then moves to the step $A_3$ to determine if the timer 39 has run down. If it has not, the program continues to repeat until the timer has run down. Therefore, regardless of whether the abnormal condition sensed by the sensor 21 or 24 has been rectified or the system is reset by actuating either the neutral switch 22 or returning the throttle to idle position the warning will continue.

If, however, the time period of the timer 39 has run down the program then moves to the step $A_4$ to determine if the abnormal condition has been terminated. If it has not, the program continues to repeat until it has.

If, however, at the step $A_4$ it is determined that the abnormal condition has been terminated then the program moves to the step $A_5$ to determine if either of the reset conditions have been accomplished. That is, it is determined at the step $A_5$ if the transmission has been moved to neutral by operation of the neutral detector switch 22 or if the throttle has been returned to the idle position as determined by the throttle position sensor 23. If not, the program continues to repeat. If, however, the reset condition has been met then the holding circuits 26 and 28 will be released and the warning will be extinguished and normal engine operation will be possible.

Figure 4:
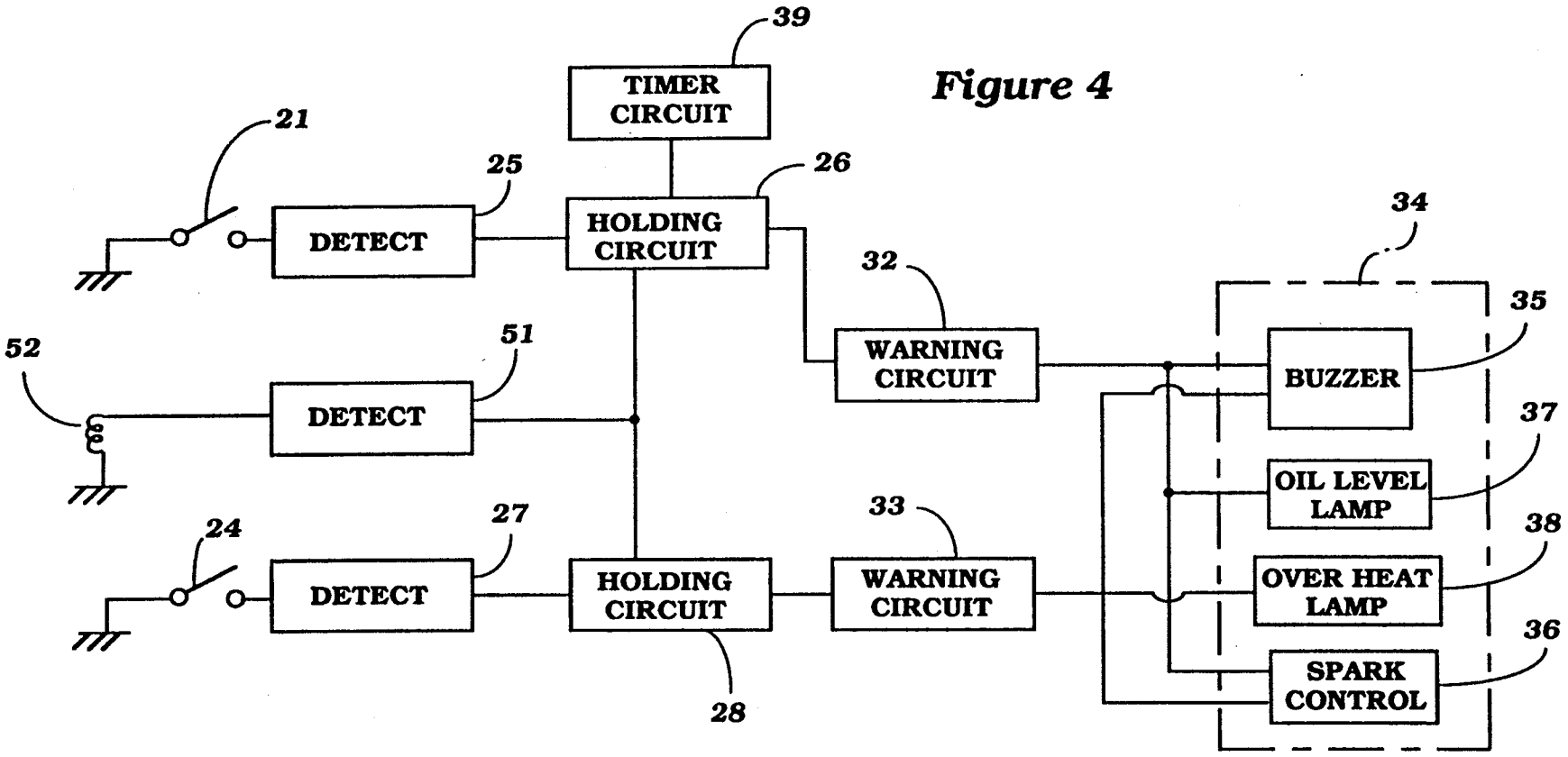
FIG. 4 is a diagrammatic view, in part similar to FIG. 2, and shows another embodiment of this invention.
Figure 5:
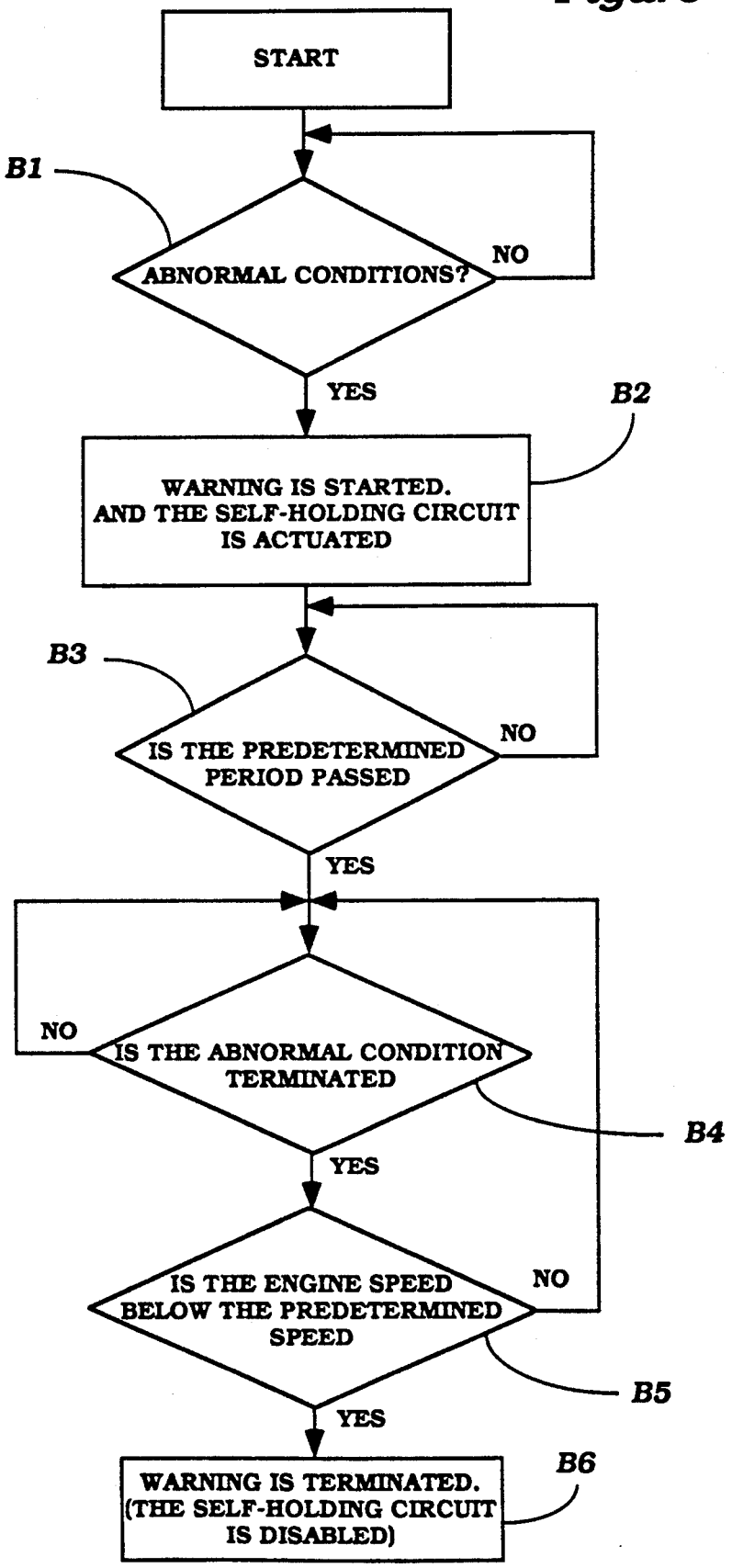
FIG. 5 is a block diagram showing the control routine of the embodiment shown in FIG. 4.

FIGS. 4 and 5 show another embodiment of the invention wherein the device is reset by returning the engine speed to a speed below a predetermined speed. This embodiment includes the float operated switch 21 and overheat sensor 24 and those elements and those associated with them in the control circuit which are the same as the previously described embodiment have been identified by the same reference numerals and the description of them and their operation will be repeated only insofar as is necessary to understand the construction and operation of this embodiment.

In this embodiment, an engine speed sensor, indicated generally by the reference numeral 51 receives a signal from the pulser coil 52 of the ignition circuit. From this, there is provided an output signal when the engine speed is below a predetermined speed so as to reset the holding circuits 26 and/or 28. However, the timer 39 is also incorporated as would the previously described embodiment so as to prevent the resetting of the device until the predetermined time period has elapsed.

This operation may be understood by reference to FIG. 5 which is a block diagram showing the logic by which this system operates. Again, once the program has started the program moves to a step $B_1$ to determine if an abnormal condition is sensed by either of the sensors 21 or 24. If it is not, the program repeats.

If, however, it is determined at the step $B_1$ that an abnormal condition is in existence, the program moves to the step $B_1$ to set the holding circuits 26 and 28 and to begin the timer 39 to operate. At the same time, the appropriate warning and engine protections will be accomplished as aforedescribed.

If the warning has been initiated, the program moves to the step $B_3$ to determine time intervals if the timer 39 has run down. If it has not, the program continues to repeat.

If, however, it is determined that the timer 39 has run down then the program moves to the step $B_4$ to determine if the abnormal condition has been terminated. If it has not, the program continues to repeat.

If, at the step $B_4$ it is determined that the abnormal condition has been terminated, then the program moves to the step $B_5$ to determine if the engine speed has been reduced below the predetermined speed as sensed by the device 51. If it has, the program then moves to the step $B_6$ so as to return to normal control. If it has not, the program repeats.

It should be readily apparent from the foregoing description that the described embodiments of the invention are extremely effective in providing good engine protection for abnormal condition, permit the operator to reset but also prevent the operator from resetting until a sufficient time period has elapsed for him to determine what the abnormal condition is. Although two embodiments of the invention have been illustrated and other embodiments additionally described, various changes and modifications may be made without departing from the spirit and scope of the invention, as defined by the appended claims.

I claim:

1. A warning system for an engine having an abnormal condition sensor, warning means for providing a warning in the event the abnormal condition has been sensed, reset means for permitting the operator to reset the warning means to a non-warning condition, and timer means for maintaining the warning means in a warning mode for a predetermined time period even if the reset device is set before the time period expires.

2. A warning system as set forth in claim 1 further including holding means for holding the warning means in its warning mode even if the abnormal condition is removed before the time period expires.

* * * * *